United States Patent [19]

Rankin

[11] 4,039,393

[45] Aug. 2, 1977

[54] APPARATUS FOR CLEANING COKE OVEN ASCENSION PIPE

[75] Inventor: Robert C. Rankin, Munster, Ind.

[73] Assignee: Interlake, Inc., Oak Brook, Ill.

[21] Appl. No.: 707,369

[22] Filed: July 21, 1976

[51] Int. Cl.[2] ..... C10B 43/06; B08B 1/00

[52] U.S. Cl. ..... 202/241; 15/104.16

[58] Field of Search ..... 202/241; 15/104.1, 104.16; 201/2

[56] References Cited

U.S. PATENT DOCUMENTS

| | | | |
|---|---|---|---|
| 2,390,105 | 12/1945 | Kirkpatrick | 15/104.1 C X |
| 3,400,052 | 9/1968 | Olsen | 15/104.16 X |
| 3,841,977 | 10/1974 | Stanke et al. | 202/241 |

*Primary Examiner*—Morris O. Wolk
*Assistant Examiner*—Roger F. Phillips
*Attorney, Agent, or Firm*—Vogel, Dithmar, Stotland, Stratman & Levy

[57] ABSTRACT

An elongated shaft with a rotating conical cutting head at one end thereof is driven upwardly from within a coke oven chamber through the exhaust port and ascension pipe of the coke oven for loosening and removing from the inner surfaces thereof material deposited thereon. The shaft, the drive means for rotating the cutting head and for moving the shaft upwardly and downwardly and a cylindrical sleeve for receiving the shaft when retracted from the exhaust port are all mounted on a carriage disposed for rolling engagement into and out of the coke oven chamber along a track carried by a support means and chassis which are in turn adapted for rolling along a railway track adjacent to the coke discharge side of a bank of coke ovens.

14 Claims, 1 Drawing Figure

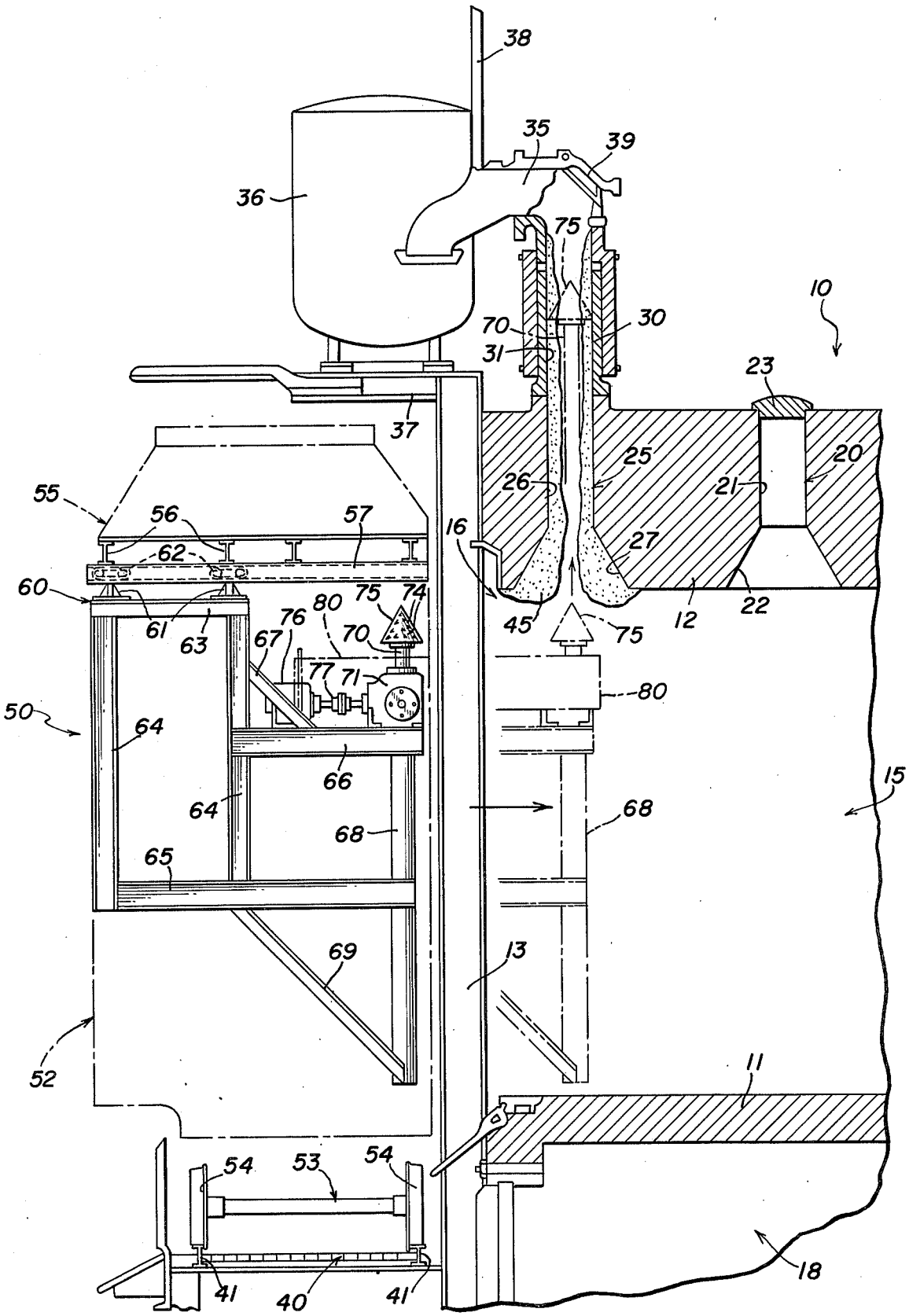
38
35
39
36
75
10
70
30
31
23
37
25
20
26
21
55
56
57
16
27
62
60
75
74
80
76
61
63
67
70
45
75
12
22
77
71
80
50
64
66
15
64
68
68
65
69
13
52
11
54
53
54
18
41
40
41

APPARATUS FOR CLEANING COKE OVEN ASCENSION PIPE

BACKGROUND OF THE INVENTION

The present invention relates to apparatus for cleaning carbon deposits from the inner surfaces of the exhaust port and ascension pipe of a coke oven.

In a by-product coke oven, the by-product gases as well as various effluents generated during the coking process pass from the coke oven chamber through an exhaust port and an ascension pipe into collector apparatus. Because of the nature of the gas and the various chemical reactions of the coking process, there is a tendency for carbon to deposit and build up on the several surfaces which are exposed to the gas, particularly the inner surfaces of the exhaust port and the ascension pipe. If this buildup is not periodically removed, severe operating problems can result, as well as a marked increase in the emission of pollutant fumes.

Because of its design and location above the coke oven, the ascension pipe, as well as the discharge port communicating therewith have heretofore been cleaned manually from the top. More particularly, access was had to the top of the ascension pipe through a hatch in the gooseneck pipe attached thereto, and a ram was manually forced down through the ascension pipe and coke oven exhaust port for scraping carbon deposits from the inner surfaces tereof. This is an extremely difficult and uncomfortable task, both because of the location of the ascension pipe and because of the extremely high heat generated by the coking process. Furthermore, this manual ramming technique sometimes does not adequately clean the inside of the ascension pipe and exhaust port, in which case the remaining deposits must be burned out with an air lance from the top of the ascension pipe, the latter task also being a difficult and uncomfortable one.

SUMMARY OF THE INVENTION

The present invention provides an apparatus for remotely and mechanically cleaning the coke oven exhaust port and ascension pipe from inside the coke oven chamber, but without exposing a man to the extremely high temperatures in the coke oven chamber.

More particularly, the present invention provides a cleaning member which is moved upwardly and downwardly through the exhaust port and ascension pipe, the movement of the cleaning member serving to effectively remove the material deposited on the inner surfaces of the exhaust port and ascension pipe as it moves upwardly and downwardly therethrough.

It is an important feature of the present invention that the cleaning member and the drive means therefor can be moved into and out of the oven chamber, so that the exhaust port and ascension pipe can be cleaned after the coke has been discharged from the oven chamber and before recharging with coal, and the cleaning apparatus can be completely withdrawn from the coke oven chamber during the coking process.

These features are accomplished in the present invention and it is an object of the present invention to accomplish these desired results by providing apparatus for cleaning the exhaust port and the ascension pipe of a coke oven chamber, the apparatus comprising an elongated shaft disposable in use in the coke oven chamber beneath the associated exhaust port substantially coaxially therewith and with the associated ascension pipe, a cleaning head carried by the shaft at the upper end thereof and having a maximum outer diameter only slightly less than the inner diameter of the associated exhaust port and ascension pipe, and drive means coupled to the shaft for effecting reciprocating movement between a retracted position wherein the cleaning head is disposed beneath the associated exhaust port and a fully extended position wherein the cleaning head is disposed within the ascension pipe adjacent to the upper end thereof, thereby to effect loosening and removal of material deposited on the inner surfaces of the associated exhaust port and ascension pipe.

In connection with the foregoing object, it is another object of this invention to provide cleaning apparatus of the type set forth, which includes additional drive means coupled to the shaft for effecting rotation of the shaft and the cleaning head about the longitudinal axis of the shaft as the shaft undergoes its reciprocating movement.

Still another object of this invention is to provide cleaning apparatus of the type set forth, wherein the shaft and the drive means are mounted on a carriage which is in turn mounted adjacent to the coke oven chamber for movement between a cleaning position extending into the coke oven chamber and a withdrawn position disposed completely outside of the coke oven chamber.

Further features of the invention pertain to the particular arrangement of the parts of the cleaning apparatus whereby the above-outlined and additional operating features thereof are attained.

The invention, both as to its organization and method of operation, together with further objects and advantages thereof, will best be understood by reference to the following specification taken in connection with the accompanying drawing.

BRIEF DESCRIPTION OF THE DRAWING

The one FIGURE of the drawing is a side elevational view of the cleaning apparatus of the present invention, illustrating the various movements thereof with respect to an associated coke oven which is shown partially in vertical section.

DESCRIPTION OF THE PREFERRED EMBODIMENT

There is shown in the drawing a coke oven, generally designated by the numeral 10 of standard construction, which includes a bottom wall or floor 11 and a top wall 12 and a pair of opposed side walls (not shown). The coke oven 10 is preferably one of several like coke ovens arranged in a bank in side-by-side relationship as illustrated, for example, in U.S. Pat. No. 3,862,889, issued on Jan. 28, 1975 to E. F. Lowe, Jr., entitled "Coke Oven Charging System", and assigned to the assignee of the present invention. The coke ovens 10 are all supported on a suitable foundation and are provided with buckstays 13, which serve to constrain the horizontal expansive forces of the heated oven brickwork.

The walls of the coke oven 10 cooperate to define a coke oven chamber 15 therein in which the coking process takes place. The coke oven chamber 15 is provided at the left-hand end thereof, as viewed in the drawing, with a coke discharge doorway, closed by doors (not shown) which may be opened to accommodate discharge of the coke from the coke oven chamber 15 at the conclusion of a cycle of the coking process, the coke normally being pushed through the doorway 16 by means of a pusher (not shown) which is driven from the opposite end of the coke oven 10. Typically, there is provided beneath the coke oven floor 11 a regenerator section 18, as explained more fully in the aforementioned U.S. Pat. NO. 3,862,889.

Formed in the top wall 12 of the coke oven 19 are a plurality of charging ports, generally designated by the numeral 20 (one shown), each having a circular cylindrical upper section 21, the lower end of which joins and is coaxial with a frustopyramidal lower section 22, the charging port 20 providing access to the coke oven chamber 15 for charging coking coal thereinto. When a fresh charge of coal is not being introduced into the coke oven chamber 15 through the charging port 20, the upper end of the cylindrical section 21 thereof is closed by a suitable cover 23. Also extending through the top wall 12 of the coke oven 10 adjacent to the doorway 16 is an exhaust port, generally designated by the numeral 25, which includes a circular cylindrical upper section 26, the lower end of which joins and is coaxial with a frustopyramidal lower section 27.

Fixedly secured to the top wall 12 at the upper end of the exhaust port 25 is an ascension pipe 30 which has a circular cylindrical inner surface 31 coaxial with and having the same inner diameter as the cylindrical portion 26 of the exhaust port 25. The ascension pipe 30 provides communication between the exhaust port 25 and a gooseneck coupling pipe 35 which is flexibly secured to the ascension pipe 30 and is fixedly secured to and communicates with a collector main 36 which is mounted upon brackets 37 extending outwardly from and supported by the buckstays 13. Preferably, the collector main 36 extends the entire length of the bank of coke ovens 10, each of the coke ovens 10 having an ascension pipe and gooseneck pipe arrangement providing communication between the coke oven chamber 15 and the collector main 36. Normally a walkway will be provided along the top of the collector main 36, which may be protected by a railing 38. The gooseneck pipe section 35 is provided with an access hatch 39 to provide access to the interiors of the gooseneck fitting 35 and the ascension pipe 30. It is through such hatches that the ascension pipe 30 has heretofore been cleaned by manual methods.

The coke oven 10 is preferably provided with a railway-type track, generally designated by the numeral 40, running along the entire length of the bank of coke ovens 10, closely adjacent to the coke discharge sides thereof, the railway track 40 including the standard pair of rails 41.

During the operation of the coke oven 10, the by-product gases as well as various effluents generated during the coking process pass from the coke oven chamber 15 through the exhaust port 25 and ascension pipe 30 to the collector main 36. Because of the nature of the exhaust gases and the various chemical reactions of the coking process, there is a tendency for carbon to deposit and build up, as at 45, along the inner surfaces of the exhaust ports 25 and ascension pipe 30.

The present invention includes a cleaning assembly, generally designated by the numeral 50, which preferably includes a railway car-like chassis 52, supported upon a railway truck 53 having wheels 54 for rolling along the railway track 40 adjacent to the coke ovens 10. The cleaning assembly 50 includes a support frame, generally designated by the numeral 55, which includes a plurality of I-beams 56 extending generally parallel to the track 40 and spaced apart generally transversely thereof. Fixedly secured to the I-beams 56 and extending substantially perpendicular thereto is a channel member 57, which is mounted with the channel disposed on edge to define a track.

The cleaning assembly 50 also includes a carriage, generally designated by the numeral 60, which has a pair of mounting shoes 61 each provided with a pair of spaced-apart roller wheels 62 dimensioned and arranged to be received in the channel of the channel member 57 for rolling engagement with respect thereto. The shoes 61 are preferably spaced-apart transversely of the chassis 52 and are both fixedly secured to and joined together by a beam 63 extending parallel to the channel member 57. Respectively fixedly secured to the beam 63 adjacent to the opposite ends thereof and extending vertically downwardly therefrom are two upright members 64, the lower ends of which are fixedly secured to a bottom beam 65, which extends transversely of the chassis 52 toward the coke oven 10 well beyond the uprights 64.

Fixedly secured to the inner one of the uprights 64 intermediate the ends thereof and extending therefrom toward the coke oven 10 substantially parallel to the bottom beam 65 is an intermediate beam 66, a brace strut 67 extending between the intermediate beam 66 in the adjacent upright 64 to provide support for the former. Fixedly secured to the bottom and intermediate beams 65 and 66 adjacent to the ends thereof closest to the coke oven 10, and extending substantially vertically from a point just above the level of the coke oven bottom wall 11 is a cylindrical sleeve or housing 68, the bottom end of which is additionally connected to the bottom beam 65 by a brace strut 69 for providing additional support to the sleeve 68.

Carried by the carriage 60 and within the sleeve 68 substantially coaxially therewith is an elongated cleaning shaft 70. Mounted on the intermediate beam 66 adjacent to the distal end thereof is a drive motor 71 which is coupled to the cleaning shaft 70 for effecting reciprocating-type movement thereof vertically upwardly and downwardly. The drive motor 71 and its coupling to the shaft 70 may be in the form of a screw jack mechanism, but any other suitable drive arrangement for effecting the up and down reciprocating movement of the cleaning shaft 70 could be used. A conical cleaning head 75 is mounted on the cleaning shaft 70 at its upper end and is preferably provided along the outer surface thereof with cutting members or teeth 74.

Also mounted on the intermediate beam 66 is a drive motor 76 which is coupled by a suitable drive train 77 to the cleaning shaft 70 for effecting rotational movement thereof about the longitudinal axis thereof, thereby effecting rotation of the cleaning head 75. It will be understood that any suitable drive means could be utilized for rotating the cleaning head 75 by means of rotating the cleaning shaft 70 or, alternatively, by rotating the cleaning head 75 with respect to the cleaning shaft 70, as long as the cleaning head 75 can be rotated at the same time that the cleaning shaft 70 undergoes its reciprocating up and down movement. There is also preferably provided a heat shield, diagrammatically illustrated at 80, for protecting the drive motors 71 and 76 and the drive train 77 from the intense heat generated within the coke oven chamber 15. For the same purpose, it will be understood that suitable insulation may be used wherever desired or necessary on the cleaning assembly 50.

In operation, after a cycle of the coking process has been completed and the coke has been discharged into a receiving vehicle through the doorway 16 in standard fashion, while the discharge doors are still open, the cleaning assembly 50 is rolled into place in front of the open coke oven chamber 15, to the position illustrated in the drawing. At this time, the carriage 60 is disposed in a withdrawn position, illustrated in the drawing, completely outside of the coke oven 10, so as to permit free and unhampered rolling of the cleaning assembly 50 along the railway track 40. When placed in position in front of the open coke oven chamber 15, the carriage 60 is then moved to the right, as viewed in the drawing, along the track formed by the channel member 57 to a cleaning position, illustrated in broken line in the drawing, wherein the cleaning shaft 70 is disposed within the coke oven chamber 15 immediately below the exhaust port 25 and coaxially therewith.

When thus positioned, the drive motors 71 and 76 are actuated to rotate the cleaning head 75 and to move the cleaning shaft 70 upwardly into and through the exhaust port 25 and the ascension pipe 30. The maximum outer diameter of the cleaning head 75 at the base thereof is only slightly less than the minimum inner diameter of the cylindrical section 26 of the exhaust port 25 and the ascension pipe 30. Thus, as the cleaning head 75 rotates up through the exhaust port 25 and the ascension pipe 30, it engages and cuts through the carbon deposits 45 built up on the inner surfaces thereof in much the same manner as a drill bit. The rotational movement of the cleaning head 75 serves to facilitate the movement thereof upwardly through the exhaust port 25 and ascension pipe 30 and serves to effectively loosen and remove all of the carbon deposits 45 in the ascension pipe 30 in the cylindrical section 26 of the exhaust port 25. It will be understood that, if necessary, the cleaning shaft 70 may be moved upwardly and downwardly through the exhaust port 25 and ascension pipe 30 a number of times to achieve an optimum cleaning effect. Preferably, during this cleaning operation, the cleaning shaft 70 is moved between the retracted position illustrated in solid line in the drawing and a fully extended position illustrated in broken line, wherein the cleaning head 75 is disposed closely adjacent to the upper end of the ascension pipe 30.

After the cleaning operation has been completed, the cleaning shaft 70 is completely retracted into the sleeve 68, the drive motors 71 and 76 are shut down, and the carriage 60 is returned to its fully withdrawn position illustrated in solid line in the drawing. Then, the cleaning assembly 50 may be moved along the track 40 to the next coke oven 10 in the bank, or may be completely removed from the area of the bank of coke ovens. When the cleaning operation has been completed, the coke discharge doors to the coke oven chamber 15 are closed and the coke oven chamber 15 is recharged with coking coal through the charging ports 20 for the next cycle of the coking process.

Preferably, the cleaning assembly 50 includes suitable drive means mounted on the chassis 52 for effecting movement of the carriage 60 between the cleaning and withdrawn positions thereof illustrated in the drawing. The chassis 52 may be self-propelled or, alternatively, may be pulled along the track 40 by the standard coke oven door machine.

It will be understood that the operations of the cleaning assembly 50, including movement of the chassis 52 along the track 40, movement of the carriage 60 along the channel member 57, and movement of the cleaning shaft 70 and the cleaning head 75 by means of the drive motors 71 and 76, may all be effected remotely. Thus, an operator may be stationed on or adjacent to the chassis 52 in a position sheltered from the heat of the coke ovens, for controlling the operation of the cleaning assembly 50; or, alternatively, the operator could be stationed at a location completely removed from the bank of coke ovens 10 for truly remote operation of the cleaning assembly 50. In either arrangement, the operator of the cleaning assembly 50 need never be exposed to the inhospitable environment of the coke oven 10, and the cleaning of the exhaust port 25 and ascension pipe 30 is completed quickly and efficiently, resulting in minimal downtime for the coke oven 10. Furthermore, it will be appreciated that two or more channel members 57 could be used to form tracks for the carriage 60.

From the foregoing, it can be seen that there has been provided a unique apparatus for effecting efficient cleaning of the exhaust port and ascension pipe of a coke oven from inside the coke oven chamber, without exposing human operators to the dangerous and uncomfortable environment of the coke oven.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. Apparatus for cleaning the exhaust port and the ascension pipe of a coke oven chamber, said apparatus comprising an elongated shaft, support means for supporting said shaft and positioning it in the coke oven chamber beneath the associated exhaust port substantially coaxially therewith and with the associated ascension pipe, a cleaning head carried by said shaft at the upper end thereof and having a maximum outer diameter only slightly less than the inner diameter of the associated exhaust port and ascension pipe, and drive means carried by said support means and coupled to said shaft for effecting reciprocating movement thereof between a retracted position wherein said cleaning head is disposed beneath the associated exhaust port and a fully extended position wherein said cleaning head is disposed within the ascension pipe adjacent to the upper end thereof, thereby to effect loosening and removal of material deposited on the inner surfaces of the associated exhaust port and ascension pipe.

2. The apparatus set forth in claim 1, wherein said cleaning head is conical in shape.

3. The apparatus set forth in claim 1, and further including a cylindrical sleeve mounted for receiving thereinto said shaft in the retracted position thereof.

4. Apparatus for cleaning the exhaust port and the ascension pipe of a coke oven chamber, said apparatus comprising an elongated shaft, support means for supporting said shaft and positioning it in the coke oven chamber beneath the associated exhaust port substantially coaxially therewith and with the associated ascension pipe, a cleaning head carried by said shaft at the upper end thereof and having a maximum outer diameter only slightly less than the inner diameter of the associated exhaust port and ascension pipe, first drive means carried by said support means and coupled to said cleaning head for effecting rotation thereof about the longitudinal axis of said shaft, and second drive means carried by said support means and coupled to said shaft and operative while said cleaning head is being rotated by said first drive means for effecting reciprocating movement of said shaft between a retracted position wherein said cleaning head is disposed beneath the associated exhaust port and a fully extended position wherein said cleaning head is disposed within the ascension pipe adjacent to the upper end thereof, thereby to effect loosening and removal of material deposited on the inner surfaces of the associated exhaust port and ascension pipe.

5. The apparatus set forth in claim 4, wherein said cleaning head includes cutting means to facilitate passage of said cleaning head through the associated exhaust port and ascension pipe and removal of deposited material therefrom.

6. The apparatus set forth in claim 4, wherein said cleaning head comprises a conical cutting head.

7. The apparatus set forth in claim 4, and further including a heat shield disposed about said first and second drive means for protection of same from heat emanating from the associated coke oven chamber.

8. The apparatus set forth in claim 4, wherein said first drive means is coupled to said shaft for effecting rotation thereof and thereby effecting rotation of said cleaning head.

9. Apparatus for cleaning the exhaust port and ascension pipe of a coke oven chamber, said apparatus comprising a carriage mounted adjacent to the coke oven chamber for movement between a cleaning position extending into the coke oven chamber and a withdrawn position disposed completely outside of the coke oven chamber, an elongated shaft carried by said carriage and disposed in the coke oven chamber substantially coaxially with the associated exhaust port and ascension pipe when said carriage is in the cleaning position thereof, a cleaning head carried by said shaft at the upper end thereof and having a maximum outer diameter only slightly less than the inner diameter of the associated exhaust port and ascension pipe, and drive means mounted on said carriage and coupled to said shaft and operable when said carriage is in the cleaning position thereof for effecting reciprocating movement of said cleaning shaft between a retracted position wherein said cleaning head is disposed beneath the associated exhaust port and a fully extended position wherein said cleaning head is disposed within the ascension pipe adjacent to the upper end thereof, thereby to effect loosening and removal of material deposited on the inner surfaces of the associated exhaust port and ascension pipe.

10. The apparatus set forth in claim 9, and further including support means for said carriage disposed outside of and adjacent to the associated coke oven chamber and including an elongated track member, said carriage including roller wheels disposed for rolling engagement along said track member for accommodating movement of said carriage between the withdrawn and cleaning positions thereof.

11. The apparatus set forth in claim 9, and further including support means for said carriage disposed outside of and adjacent to the associated coke oven chamber and including an elongated track member, said carriage including roller wheels disposed for rolling engagement along said track member for accommodating movement of said carriage between the withdrawn and cleaning positions thereof, and means for moving said support means and said carriage to and from a position adjacent to the associated coke oven chamber when said carriage is in the withdrawn position thereof.

12. The apparatus set forth in claim 9, and further including a cylindrical sleeve mounted on said carriage and disposed for accommodating therein said shaft in the retracted position thereof.

13. Apparatus for cleaning the exhaust port and ascension pipe of a coke oven chamber, said apparatus comprising a carriage mounted adjacent to the coke oven chamber for movement between a cleaning position extending into the coke oven chamber and a withdrawn position disposed completely outside of the coke oven chamber, an elongated shaft carried by said carriage and disposed in the coke oven chamber substantially coaxially with the associated exhaust port and ascension pipe when said carriage is in the cleaning position thereof, a cleaning head carried by said shaft at the upper end thereof and having a maximum outer diameter only slightly less than the inner diameter of the associated exhaust post and ascension pipe, first drive means mounted on said carriage and coupled to said cleaning head for effecting rotation thereof about the longitudinal axis of said shaft, and second drive means mounted on said carriage and coupled to said shaft and operable when said carriage is in the cleaning position thereof and while said cleaning head is being rotated by said first drive means for effecting reciprocating movement of said shaft between a retracted position wherein said cleaning head is disposed beneath the associated exhaust port and a fully extended position wherein said cleaning head is disposed within the ascension pipe adjacent to the upper end thereof, thereby to effect loosening and removal of material deposited on the inner surfaces of the associated exhaust port and ascension pipe.

14. The apparatus set forth in claim 13, and further including a heat shield disposed about said first and second drive means for protection of same from heat emanating from the associated coke oven chamber.

* * * * *

UNITED STATES PATENT AND TRADEMARK OFFICE

CERTIFICATE OF CORRECTION

PATENT NO. : 4,039,393

DATED : August 2, 1977

INVENTOR(S) : Robert C. Rankin

It is certified that error appears in the above-identified patent and that said Letters Patent are hereby corrected as shown below:

Column 1, line 29, "tereof" should be --thereof--.
Column 2, line 6, after "movement" insert --thereof--.
Column 3, line 6, "19" should be --10--.
Column 4, line 30, after "the" first occurrence insert --intermediate beam 66 to a point just above the--.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*